US012799769B2

(12) United States Patent
Brockman

(10) Patent No.: US 12,799,769 B2
(45) Date of Patent: Nov. 17, 2026

(54) FENCE GRASS GUARD

(71) Applicant: Bill Brockman, Harrison, AR (US)

(72) Inventor: Bill Brockman, Harrison, AR (US)

( * ) Notice: Subject to any disclaimer, the term of this patent is extended or adjusted under 35 U.S.C. 154(b) by 134 days.

(21) Appl. No.: 18/925,613

(22) Filed: Oct. 24, 2024

(65) Prior Publication Data

US 2025/0320748 A1 Oct. 16, 2025

Related U.S. Application Data

(60) Provisional application No. 63/634,076, filed on Apr. 15, 2024.

(51) Int. Cl.
*E04H 17/06* (2006.01)

(52) U.S. Cl.
CPC ..... *E04H 17/063* (2013.01)

(58) Field of Classification Search
CPC ..... E04H 17/063
See application file for complete search history.

(56) References Cited

U.S. PATENT DOCUMENTS 3,384,351 A 5/1968 Turner, Jr.
3,515,373 A 6/1970 Abbe
5,762,323 A 6/1998 Boswell
2005/0279981 A1 12/2005 Onbey
2018/0148950 A1* 5/2018 Hays ..... E04H 17/063
2022/0034119 A1* 2/2022 Mathews ..... E04H 17/009
2023/0026173 A1 1/2023 Mullin

FOREIGN PATENT DOCUMENTS

EP 3874937 A1 * 9/2021 ..... A01G 13/38
WO WO-2019229483 A1 * 12/2019 ..... E04H 17/063

* cited by examiner

*Primary Examiner* — Sarah B Mcpartlin
(74) *Attorney, Agent, or Firm* — Brennan, Manna & Diamond, LLC

(57) ABSTRACT

A fence grass guard device is disclosed for easily preventing the growth of grass in unwanted areas (i.e., under a fence) without the use of harmful chemicals or sprays. The grass guard device comprises a body component that is configured in a rectangular shape (i.e., rectilinear) and comprised of interlocking dimples and teeth. The body component comprises a plurality of interlocking dimples that snap or snag together for seamless coverage. Further, the body component has a notch cut out to accommodate and fit around a fence pole or post. The body component is secured to the ground with a plurality of sharp or pointed teeth designed to grip the ground. Further, the device can be manufactured in a plurality of colors to match the landscape design or the user's preference.

16 Claims, 3 Drawing Sheets

FENCE GRASS GUARD

CROSS-REFERENCE TO RELATED APPLICATION

The present application claims priority to, and the benefit of, U.S. Provisional Application No. 63/634,076 which was filed on Apr. 15, 2024, and is incorporated herein by reference in its entirety.

FIELD OF THE INVENTION

The present invention relates generally to the field of lawn care devices. More specifically, the present invention relates to an improved grass growth prevention device. Accordingly, the present disclosure makes specific reference thereto. Nonetheless, it is to be appreciated that aspects of the present invention are also equally applicable to other like applications, devices, and methods of manufacture.

BACKGROUND

By way of background, this invention relates to improvements in grass growth prevention devices. Generally, grass that grows underneath fences can be difficult maintain and create the appearance of lawn that is unkempt and unmanicured. Further, cutting the grass or using a weed eater or trimmer is time consuming and a labor-intensive process that is often unsuccessful for an extended period. Users desire an easier way to maintain their lawn without the struggle of continuous grass growth under a fence or wall.

Further, users desire an alternative to spraying harmful chemicals when attempting to maintain their lawn. Often, spraying chemicals can be dangerous to surrounding plants, animals, and children. Without a grass guard or similar device, the user is burdened with the task of maintaining the grass overgrowth around and under a fence using harmful chemicals or additional lawn equipment. However, most grass growth prevention and inhibitor products are chemical and require multiple applications, which are not cost effective. Further, products that are not chemically based, such as but not limited to a weed eater or trimmer, require maintenance, time, and demand a continuous financial burden to maintain.

Accordingly, there is a demand for an improved grass growth prevention device that provides a grass guard to prevent the growth of unwelcomed grass. More particularly, there is a demand for a grass guard fence device that prevents grass from growing underneath fences.

Therefore, there exists a long felt need in the art for a lawn care device that provides users with a grass growth prevention device for underneath a fence. There is also a long felt need in the art for an aesthetically appealing lawn care device that prevents the overgrowth of grass under and around a fence. Further, there is a long felt need in the art for a lawn care device that provides seamless coverage. Even further, there is a long felt need in the art for a lawn care device that has interlocking dimples for secure attachment. Moreover, there is a long felt need in the art for a lawn care device that has teeth or prongs for a stronger ground grip. Further, there is a long felt need in the art for a lawn care device that has a slot to accommodate fence poles. Moreover, there is a long felt need in the art for a device that does not require chemicals. Further, there is a long felt need in the art for a lawn care device that comes in a plurality of colors.

Finally, there is a long felt need in the art for a lawn care device that decreases time, effort, and cost to maintain a lawn.

The subject matter disclosed and claimed herein, in one embodiment thereof, comprises a lawn care device. The device is a multipurpose, grass guard for easily maintaining overgrown grass underneath and around fences while creating an aesthetically pleasing lawn. The grass guard device comprises a body component that is configured in a rectangular shape (i.e., rectilinear) with a slot cut out to fit and accommodate a fence pole or post. Moreover, the grass guard device accommodates the gaps created by fence gates. The grass guard device is comprised of a plurality of interlocking dimples and a plurality of small teeth or prongs on the bottom surface. The plurality of interlocking dimples provides overlapping secure seamless attachment to additional devices during use. The bottom side of the device comprises a plurality of small teeth so that device can be easily secured to the ground for enhanced grip during use. The grass guard device can be easily moved and adjusted to the user's desired preference. Finally, the body component can be manufactured in a plurality of colors to meet the user's desired preference.

In this manner, the grass guard fence device of the present invention accomplishes all of the forgoing objectives and provides users with a device that provides a grass guard for fences for residential and business use. The device has interlocking dimples and small teeth for secure seamless installation. The device can be easily installed, unfastened, and moved for convenience.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a lawn care device. The device is a multipurpose, grass guard for easily maintaining overgrown grass underneath fences, creating a manicured lawn without the use of harmful chemicals or time-consuming intensive labor. The grass guard device comprises a body component that includes a cut out to accommodate a fence pole or post. The body comprises a plurality of interlocking dimples and is secured to additional devices during use. The body is secured to the ground with a plurality of small teeth or prongs to eliminate device movement during use. Further, the body component can be manufactured in a variety of colors.

The present invention is directed to a grass guard fence device that has particular utility in preventing grass from growing underneath and around fences. In the present invention, the grass guard device can be easily installed and attached to multiple devices to accommodate a variety of fence sizes and perimeters. Accordingly, the grass guard device has interlocking dimples for seamless coverage, teeth for grip, and a slot cut out, to accommodate a variety of fence poles or posts, and gaps created from fence gates with case.

In one embodiment, the grass guard fence device comprises a body component that is configured in a rectangular shape (i.e., rectilinear), but can be any suitable shape and size as is known in the art. The body component comprises a top surface and a bottom surface with at least one side. The body component is typically plastic, such as silicone or polyethylene, but can also be manufactured of any suitable durable plastic, as well.

In one embodiment, the body component comprises a plurality of interlocking dimples which are configured to securely attach to additional devices for seamless coverage and convenience. Thus, the body can be expanded into an elongated rectangular configuration during use to accommodate larger perimeters. In other words, adjustments to the coverage area are accommodated by the plurality of interlocking dimples. Further, the body components can be locked and unlocked by simply snapping the dimples from each piece together.

In one embodiment, the body component has at least one cutout or notch. Typically, the notch cutout is designed to accommodate the fence pole or post for seamless coverage. Further, the notch cutout can also accommodate the poles that support the fence gate. When a user wants to install the grass guard device under a fence, the notches enable for installation without having to cut the device for each fence pole or post.

In one embodiment, the body component comprises a plurality of small teeth or pointed prongs on the bottom surface of the device. Any suitable number of teeth can be utilized as is known in the art. Further, the plurality of teeth can be any suitable size and shape as is known in the art. The teeth or prongs serve as a grip to secure the device to the ground. Generally, when users are mowing their lawn near a fence, the teeth provide stability, retention, and limited movement of the device.

In yet another embodiment, the fence grass guard device comprises a plurality of colors and tones.

In yet another embodiment, a method of easily preventing grass from growing underneath a fence is disclosed. The method includes the steps of providing a fence grass guard device comprising a body component with a notch, interlocking dimples, and teeth. The method also comprises securing the body component to another body component by snapping the interlocking dimples. Further, the method comprises placing the device under a fence with the teeth surface facing the ground around the entire perimeter. Finally, the method comprises placing the side with the notch around the fence pole.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
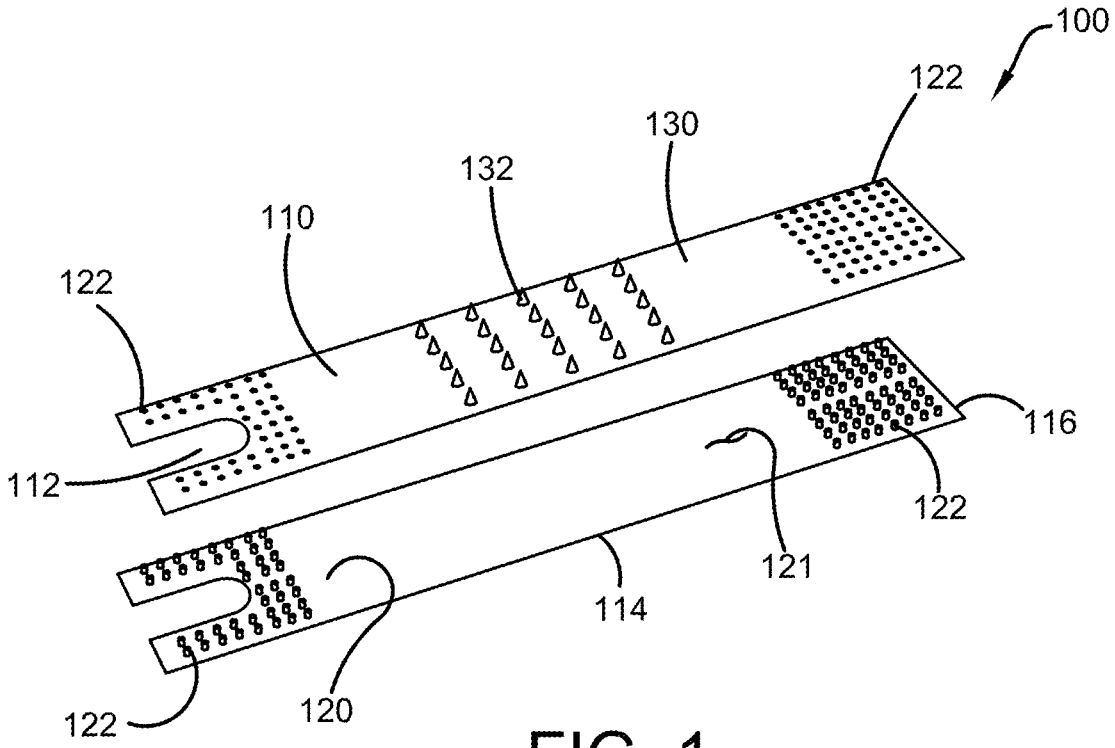
FIG. 1 illustrates a multiple perspective view of one embodiment of the fence grass guard device of the present invention showing the top side and the bottom side in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a lawn care device that provides users with a grass guard device that prevents grass from growing underneath a fence. There is also a long felt need in the art for a lawn care device that prevents the overgrowth of grass under a fence that creates a manicured lawn. Further, there is a long felt need in the art for a grass guard device that provides seamless coverage. Moreover, there is a long felt need in the art for a lawn care device that is easy to use with interlocking dimples for secure attachment. Even further, there is a long felt need in the art for a device that does not require harmful chemicals. Further, there is a long felt need in the art for a grass guard device that has teeth for ground grip to limit the movement of the device once placed. Moreover, there is a long felt need in the art for a lawn care device that has a notch cut out to accommodate fence poles and gates. Further, there is a long felt need in the art for a lawn care device that comes in a plurality of colors. Finally, there is a long felt need in the art for a lawn care device that decreases time, effort, and cost to maintain a lawn.

The present invention, in one exemplary embodiment, is a novel lawn care device. The fence grass guard device comprises a body component that is configured in a rectangular shape (i.e., rectilinear) comprised with a notch cutout on at least one side to accommodate the fence pole or post.

Further, the cutout notch fits around and under a fence gate pole and adjusts to accommodate for the gaps created by the gate. The grass guard device comprises a top surface and a bottom surface. The top surface has a plurality of interlocking dimples that overlap and snap or snag together with additional devices to create a seamless transition during use. Specifically, the grass guard device can be easily moved and adjusted by unsnapping the interlocking dimples Moreover, the present invention comprises a bottom surface comprised of a plurality of small teeth to grip the device to the ground and limit the device's movement. The present invention also includes a novel method of easily preventing the unwanted growth of grass under a fence. The method includes the steps of providing a fence grass guard device comprising a body component with a notch, interlocking dimples, and prongs. The method also comprises attaching more than one grass guard to another grass guard using the interlocking dimples. The method also comprises placing the device with the notch side around the fence pole, with bottom side down. The method also comprises placing the device under a fence with the bottom side having the teeth facing the ground. Finally, the method comprises unsnapping the body components and removing the device from under a fence.

The grass guard device can be easily moved and adjusted to the user's desired preference. Finally, the body component can be manufactured in a plurality of colors to meet the user's landscaping preference.

Referring initially to the drawing, FIG. 1 illustrates a multiple perspective view of one embodiment of the fence grass guard device 100 of the present invention; a view of the top surface 120 of the device 100 and a view of the bottom surface 130 of the device 100. In the present embodiment, the fence grass guard device 100 is an improved lawn care device 100 that provides a user with a tool that prevents grass 20 from growing in unwanted areas, such as but not limited to under and around a fence 10. Specifically, the grass guard device 100 comprises a body component 110 that is configured in a rectangular shape (i.e., rectilinear) with at least one lengthwise side 114 and at least one end or widthwise side 116. The body component 110 comprises at least one notch 112 cutout on at least one end or widthwise side 116. Further, the device 100 body component 110 is rectangular in shape, but can be any suitable size and shape as is known in the art. Moreover, the body component 110 designed in a rectangular configuration comprises two sides 114 and two end sides 116, and at least one end or widthwise side 116 with a notch cutout 112 to accommodate the fence 10.

Generally, the present invention is directed to fence grass guard device 100 that has particular utility in preventing grass 20 from growing underneath a fence 10. In the present invention, the top surface 120 of the device 100 is smooth in the center area 121 of the top surface 120, while each end of the top surface 120 has a plurality of interlocking dimples 122 with detents formed within to connect multiple devices 100. Further, the bottom surface 130 of the device 100 has a plurality of small teeth 132 in the center area, while each end of the bottom surface 130 has a plurality of interlocking dimples 122 with protrusions extending therefrom to connect to multiple devices 100. Specifically, the small teeth 132 on the bottom surface 130 are used to grip to the ground and secure the device 100, prevent movement while in use.

Figure 2:
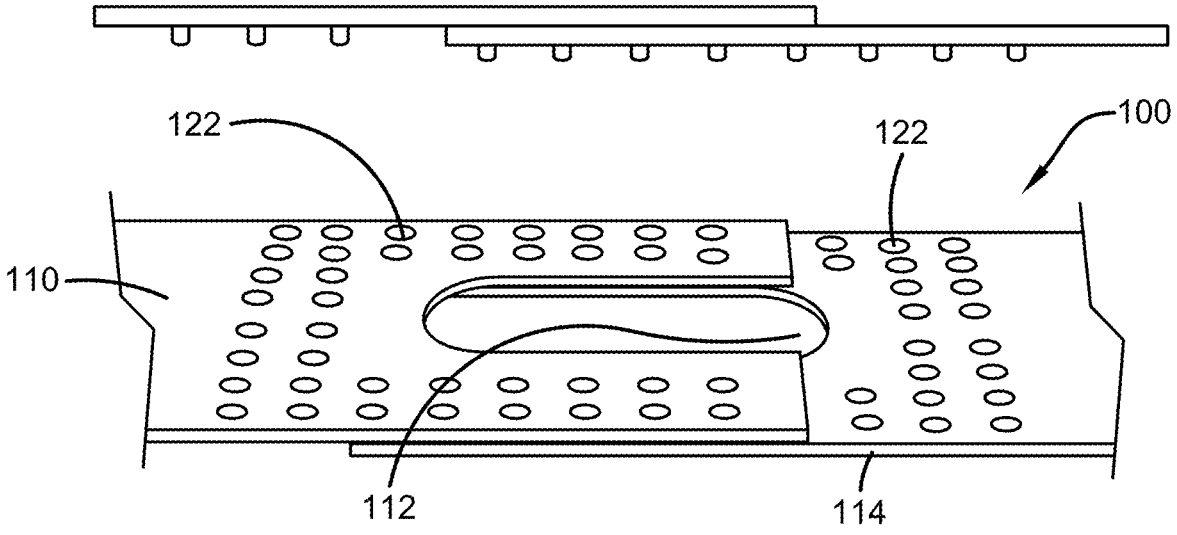
FIG. 2 illustrates a multiple perspective view of one embodiment of the fence grass guard device of the present invention showing the notch and side view in accordance with the disclosed architecture.

As shown in FIG. 2, a side view of the grass guard device 100 is illustrated. The fence grass guard device 100 comprises a body component 110 that is configured in a rectangular shape (i.e., rectilinear), but can be any suitable shape and size as is known in the art. The body component 110 comprises at least one lengthwise side 114 and at least one end or widthwise side 116. The body component is typically plastic, such as acrylic or polycarbonate, but could also be manufactured of any flexible or rubber material (i.e., recycled tires), as well. The body component comprises a plurality of interlocking dimples 122 which are located on each end of the top surface 110 and bottom surface 120 such that the protrusions interlock with the detents when two body components are layered on top of each other to enable the multiple devices 100 to connect. Further, the device 100 has a notch 112 at one end side 116 to accommodate the fence pole or post 11. Thus, multiple devices 100 can be connected to expand to cover a larger surface area. In other words, the fence grass guard device 100, when connected to other devices 100, can accommodate any length or any size perimeter. Further, to ensure the device 100 has seamless coverage around the fence pole or post 11, two end sides 116 with the notch cutout 112, are placed facing each other and snapped together using the interlocking dimples 122.

Figure 3:
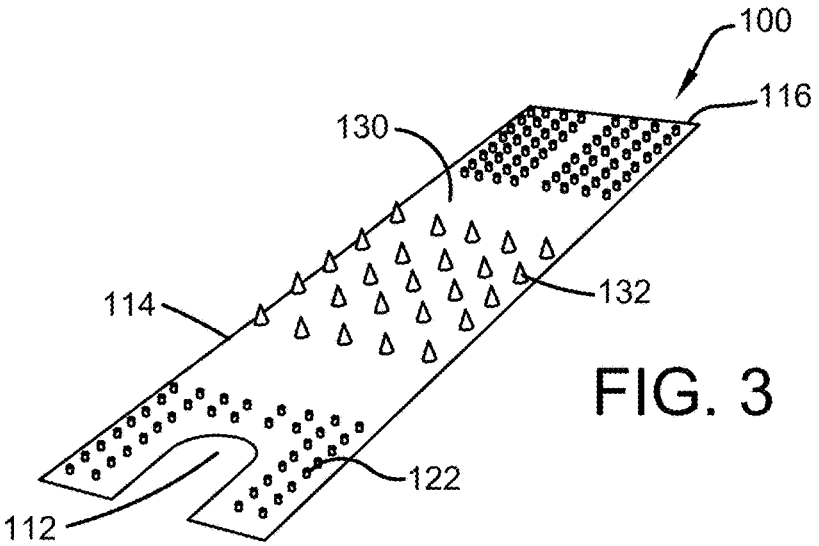
FIG. 3 illustrates a perspective view of one embodiment of the fence grass guard device of the present invention showing the teeth on the bottom surface in accordance with the disclosed architecture.

As shown in FIG. 3, a view of the bottom surface 130 of the device 100 is illustrated. The fence grass guard device 100 comprises a plurality of sharp or cone-shaped teeth 132 evenly dispersed across the center of the bottom surface 130 to provide a more secure ground grip and limit the movement of the device 100. Any suitable number of teeth 132 can be utilized as is known in the art. Further, the plurality of teeth 132 can be any suitable size and shape as is known in the art. Moreover, the interlocking dimples 122 at each end of the device 100, provide seamless coverage for optimal results.

Figure 4:
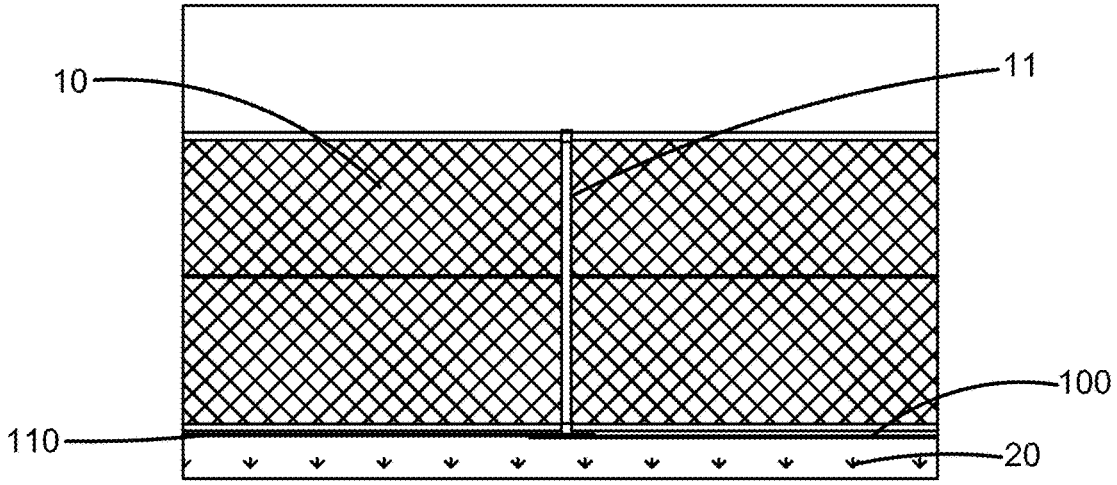
FIG. 4 illustrates a perspective view of one embodiment of the fence grass guard device of the present invention showing the device from a distance in place under a fence in a yard in accordance with the disclosed architecture.

As shown in FIG. 4, the fence grass guard device 100 comprises a body component 110 configured in a rectangular shape (i.e., rectilinear) and is placed under a fence 10 for easy installation. Typically, multiple devices 100 are snapped together via the interlocking dimples 122 such that the protrusions interlock with the detents when two body components are layered on top of each other for complete seamless coverage and a tidy appearance. Specifically, when the device 100 is in place, it assists with the yard maintenance and limits the growth of unwanted grass 20 in targeted areas.

Figure 5:
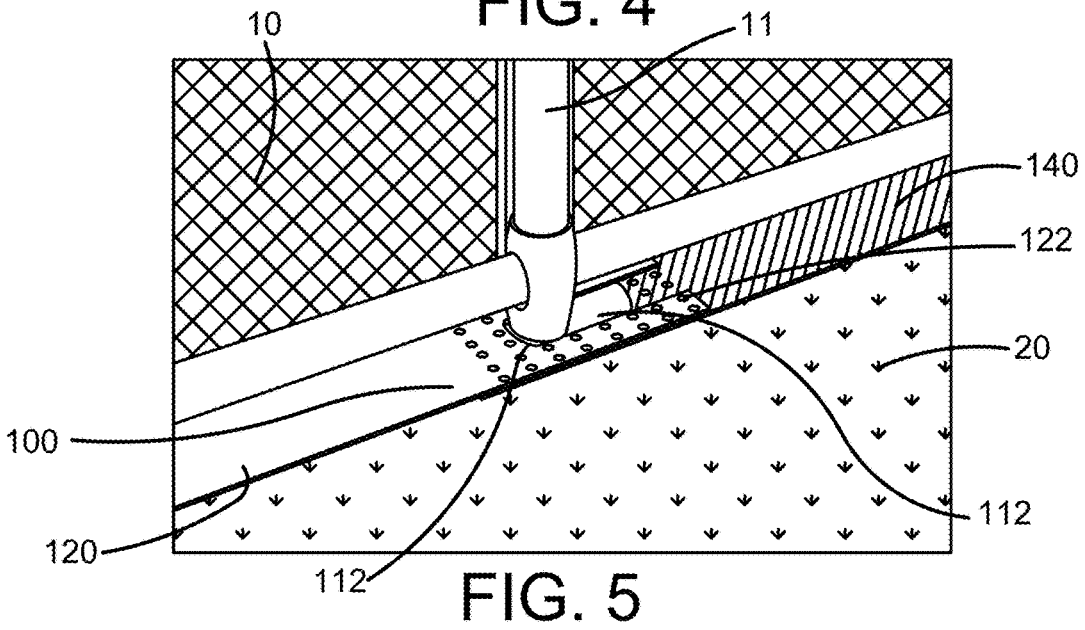
FIG. 5 illustrates a perspective view of one embodiment of fence grass guard device of the present invention showing an enlarged view of the device in place around and under a fence post in accordance with the disclosed architecture.

As shown in FIG. 5, the fence grass guard device 100 comprises a notch 112 on at least one end or widthwise side 116. The body component 110 comprises a notch 112 for the device 100 to fit around a fence pole 11 and under a fence 10 and provide seamless coverage under the fence 10. In one embodiment, the body component 110 can be manufactured in a plurality of indica or colors 140 to meet the user's desired preference. Specifically, different types of grass 20 can grow in a variety of colors 140. Typically, grass 20 is thought to be green, however, grass 20 can be green, blue, brown, black, red, purple, gold, etc. Moreover, the fence grass guard device 100 can be manufactured in a plurality of colors 140 to match the landscape design for which the device 100 is being used.

Figure 6:
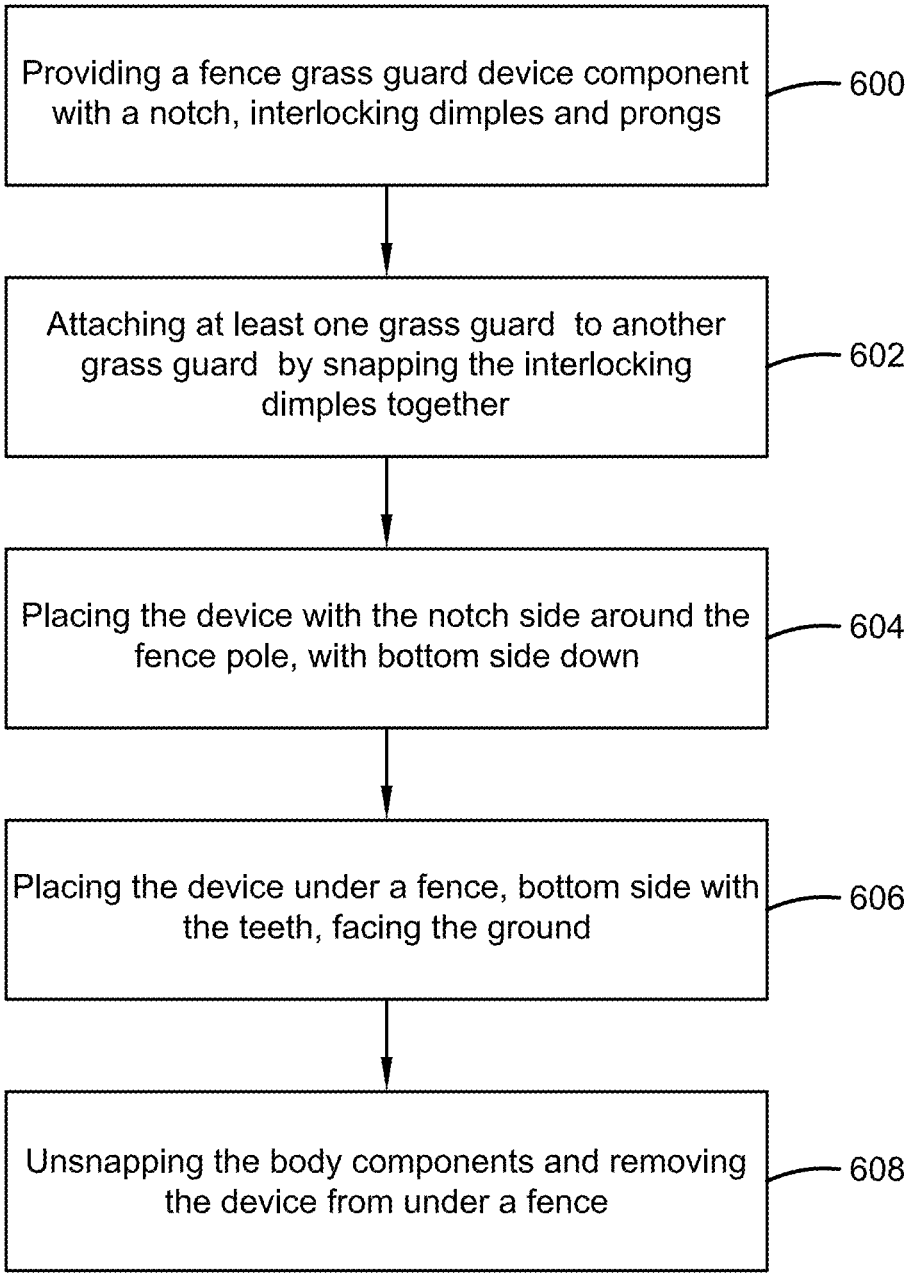
FIG. 6 illustrates a flowchart showing the method of easily preventing grass from growing underneath fences in accordance with the disclosed architecture.

FIG. 6 illustrates a flowchart of the method of easily preventing the growth of unwanted grass underneath a fence. The method includes the steps of at 600, providing a fence grass guard device comprising a body component with a notch, interlocking dimples, and prongs. The method also comprises at 602, attaching more than one grass guard to another grass guard by snapping the interlocking dimples together. Further, the method comprises at 604, placing the device with the notch side around the fence pole or post, with bottom side down. The method also comprises at 606, placing the device under a fence with the bottom side (including the teeth) facing the ground. Finally, the method comprises at 608, unsnapping the body components and removing the device from under a fence.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "fence grass guard device", "grass guard device", "lawn device", and "device" are interchangeable and refer to the under-fence grass guard device 100 of the present invention.

Notwithstanding the forgoing, the fence grass guard device 100 of the present invention can be of any suitable size and configuration as is known in the art without affecting the overall concept of the invention, provided that it accomplishes the above stated objectives. One of ordinary skill in the art will appreciate that the fence grass guard device 100 as shown in FIGS. 1-6 is for illustrative purposes only, and that many other sizes and shapes of the fence grass guard device 100 are well within the scope of the present disclosure. Although the dimensions of the fence grass guard device 100 are important design parameters for user convenience, the fence grass guard device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A fence grass guard device for prohibiting grass growth, the fence grass guard device comprising:

a grass guard including a body component having a top surface and a bottom surface;

wherein said body component having a pair of lengthwise sides and a pair of widthwise sides;

wherein at least one of said pair of widthwise sides having at least one notch cutout for accommodating a fence post therein;

wherein said top surface having a smooth central area and two top opposing dimpled end areas with detents formed therein;

wherein said bottom surface having two bottom opposing dimpled end areas with protrusions extending therefrom; and further wherein one of said two top opposing dimpled end areas with detents formed therein of a first grass guard are configured to interlock with one of said two bottom opposing dimpled areas with protrusions extending therefrom of a second grass guard for connecting said first and second grass guards when two body components are layered on top of each other.

2. The fence grass guard device for prohibiting grass growth of claim 1, wherein said bottom surface having a plurality of teeth protruding therefrom for gripping to the ground.

3. The fence grass guard device for prohibiting grass growth of claim 2, wherein each one of said plurality of teeth having a cone-shape.

4. The fence grass guard device for prohibiting grass growth of claim 3, wherein said plurality of teeth evenly dispersed across a center area of said bottom surface.

5. The fence grass guard device for prohibiting grass growth of claim 4, wherein said body component having a rectilinear shape.

6. The fence grass guard device for prohibiting grass growth of claim 5, wherein said body component having a material selected from the group consisting of a plastic, an acrylic, and a polycarbonate.

7. The fence grass guard device for prohibiting grass growth of claim 5, wherein said body component is a rubber body component.

8. The fence grass guard device for prohibiting grass growth of claim 3, wherein a first notch cutout of said first grass guard overlapping a second notch cutout of an adjacent said second grass guard for accommodating the fence post therebetween.

9. A fence grass guard device for prohibiting grass growth, the fence grass guard device comprising:

a grass guard including a body component having a top surface and a bottom surface;

wherein said body component having a pair of lengthwise sides and a pair of widthwise sides;

wherein at least one of said pair of widthwise sides having at least one notch cutout for accommodating a fence post therein;

wherein said top surface having a smooth central area and two top opposing dimpled end areas with detents formed therein;

wherein said bottom surface having two bottom opposing dimpled end areas with protrusions extending therefrom;

wherein one of said two top opposing dimpled end areas with detents formed therein of a first grass guard are configured to interlock with one of said two bottom opposing dimpled areas with protrusions extending therefrom of a second grass guard for connecting said first and second grass guards when two body components are layered on top of each other; and further wherein a first notch cutout of said first grass guard overlapping a second notch cutout of an adjacent said second grass guard for accommodating the fence post therebetween.

10. The fence grass guard device for prohibiting grass growth of claim 9, wherein said bottom surface having a plurality of teeth protruding therefrom for gripping to the ground.

11. The fence grass guard device for prohibiting grass growth of claim 10, wherein each one of said plurality of teeth having a cone-shape.

12. The fence grass guard device for prohibiting grass growth of claim 10, wherein said plurality of teeth evenly dispersed across a center area of said bottom surface.

13. The fence grass guard device for prohibiting grass growth of claim 12, wherein said body component having a rectilinear shape.

14. The fence grass guard device for prohibiting grass growth of claim 13, wherein said body component having a material selected from the group consisting of a plastic, an acrylic, and a polycarbonate.

15. The fence grass guard device for prohibiting grass growth of claim 13, wherein said body component having a material selected from the group consisting of a rubber.

16. A method of prohibiting grass growth under a fence, the method comprising the steps of:

providing a first grass guard including a body component having a top surface and a bottom surface, wherein said body component having a pair of lengthwise sides and a pair of widthwise sides, wherein at least one of said pair of widthwise sides having at least one notch cutout for accommodating a fence post therein, wherein said top surface having a smooth central area and two top opposing dimpled end areas with detents formed therein, further wherein said bottom surface having two bottom opposing dimpled end areas with protrusions extending therefrom;

positioning the notch cutout around the fence post;

positioning a notch cutout of a second grass guard around the fence post and interlocking one of said two top opposing dimpled end areas with detents formed therein of the first grass guard with one of two bottom opposing dimpled areas with protrusions extending therefrom of the second grass guard when two body components are layered on top of each other;

connecting said grass guards.

* * * * *